US007299538B2

(12) United States Patent
Tactic-Lucic

(10) Patent No.: US 7,299,538 B2
(45) Date of Patent: Nov. 27, 2007

(54) METHOD FOR FABRICATING MICRO-ELECTRO-MECHANICAL SYSTEMS

(75) Inventor: Svetlana Tactic-Lucic, Bethlehem, PA (US)

(73) Assignee: Wispry, Inc., Cary, NC (US)

( * ) Notice: Subject to any disclaimer, the term of this patent is extended or adjusted under 35 U.S.C. 154(b) by 404 days.

(21) Appl. No.: 10/966,795

(22) Filed: Oct. 14, 2004

(65) Prior Publication Data

US 2005/0048687 A1 Mar. 3, 2005

Related U.S. Application Data

(62) Division of application No. 10/622,664, filed on Jul. 18, 2003, now Pat. No. 7,064,637.

(60) Provisional application No. 60/396,869, filed on Jul. 18, 2002.

(51) Int. Cl.
*H01H 11/00* (2006.01)
*H01H 65/00* (2006.01)

(52) U.S. Cl. ..... 29/622; 29/592.1; 29/831; 29/846; 200/181; 200/600; 333/262; 438/48; 438/52

(58) Field of Classification Search ..... 29/622, 29/592.1, 831, 846; 200/181, 600; 333/262; 438/48, 52
See application file for complete search history.

(56) References Cited

U.S. PATENT DOCUMENTS

| | | | | |
|---|---|---|---|---|
| 5,578,976 | A | 11/1996 | Yao | |
| 6,054,659 | A | 4/2000 | Lee et al. | |
| 6,310,339 | B1 | 10/2001 | Hsu et al. | |
| 6,396,368 | B1 | 5/2002 | Chow et al. | |
| 6,646,215 | B1 * | 11/2003 | Nelson | 200/181 |
| 6,746,891 | B2 | 6/2004 | Cunningham et al. | |
| 6,768,403 | B2 | 7/2004 | Hsu et al. | |
| 7,053,737 | B2 * | 5/2006 | Schwartz et al. | 335/78 |

* cited by examiner

*Primary Examiner*—A. Dexter Tugbang
*Assistant Examiner*—Tim Phan
(74) *Attorney, Agent, or Firm*—Pillsbury Winthrop et al.

(57) ABSTRACT

The present invention relates to micro-electro-mechanical systems (MEMS). The present invention relates to a design feature that allows lower actuation voltage for electrostatically actuated structures (i.e., switches or mirrors). The present invention further relates to a method for fabricating such a design that allows lower actuation voltage.

2 Claims, 10 Drawing Sheets

METHOD FOR FABRICATING MICRO-ELECTRO-MECHANICAL SYSTEMS

CROSS-REFERENCE TO RELATED APPLICATION

This application is a divisional of U.S. patent application Ser. No. 10/622,664 filed Jul. 18, 2003, now U.S. Pat. No. 7,064,637, which claims the benefit of U.S. Provisional application Ser. No. 60/396,869 filed Jul. 18, 2002.

FIELD OF THE INVENTION

The present invention relates to micro-electro-mechanical systems (MEMS). The present invention relates to a design feature that allows lower actuation voltage for electrostatically actuated structures (i.e., switches or mirrors). The present invention further relates to a method for fabricating such a design that allows lower actuation voltage.

BACKGROUND OF THE INVENTION

An electrostatic MEMS switch is a switch operated by an electrostatic charge and manufactured using MEMS techniques. The MEMS switch can control electrical, mechanical, or optical signal flow, and they have application to telecommunications, such as DSL switch matrices and cell phones, Automated Testing Equipment (ATE), and other systems that require low cost switches or low-cost, high-density arrays.

Many MEMS switches are designed to employ a cantilever or beam geometry. These MEMS switches include a movable beam having a structural layer of dielectric material and a conductive/metal layer. Typically, the dielectric material is fixed at one end with respect to the substrate and provides structural support for the beam. The layer of metal is attached to the underside of the dielectric material and forms a movable electrode and a movable contact. The movable beam is actuated in a direction towards the substrate by the application of a voltage difference across the electrode and another electrode attached to the surface of the substrate. The application of the voltage difference to the two electrodes creates an electrostatic field which pulls the beam towards the substrate. The beam and substrate each have a contact which is separated by an air gap when no voltage is applied, wherein the switch is in the "open" position. When the voltage difference is applied, the beam is pulled to the substrate and the contacts make an electrical connection, wherein the switch is in the "closed" position.

MEMS switches having low actuation voltages are very desirable. The required actuation voltage can be reduced by either reducing the gap distance between the two electrodes or increasing the surface area of the electrodes. Assuming that the electrode is occupying a maximum area of the beam, the dimensions of the beam must be increased to accommodate a larger electrode. A problem associated with increasing the length of the beam is that the beam becomes more compliant, thus increasing the likelihood of stiction, i.e., a condition wherein the movable beam will not revert back to an "open" position from a "closed" position. Also, reducing the gap distance between the electrodes can increase the likelihood of stiction. Furthermore, reducing the gap distance between the electrodes can increase the difficulty in forming the protruding contacts because there is less available area beneath the movable beam to do so. Another problem with reducing the gap distance is that any stress and curvature of the beam can lead to contact of the electrodes, thus shorting the electrodes.

SUMMARY OF THE INVENTION

It is an object of the present invention to provide a design feature that allows lower actuation voltage for electrostatically actuated structures (i.e., switches or mirrors).

It is another object of the present invention to provide a method for fabricating such a design that allows lower actuation voltage.

It is another object of the present invention to provide an electrostatically actuated switch having a reduced gap distance between electrodes for reducing actuation voltage.

It is a further object of the present invention to provide a more reliable electro-statically actuated switches.

It is yet another object of the present invention to provide electro-statically actuated switches that reduce the likelihood of stiction and beam deformation.

The present invention relates to a MEMS switch having a recessed, movable electrode. Furthermore, the present invention provides a method for fabricating a MEMS switch having a recessed, movable electrode.

BRIEF DESCRIPTION OF THE DRAWINGS

These and other objects and advantages of the present invention will become apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
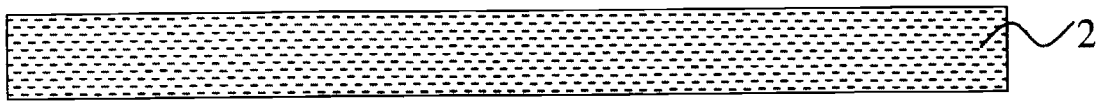
FIGS. 1-19 illustrate cross sectional views of a method for fabricating a structure in accordance with the present invention.

The preferred embodiments of the present invention will now be described with reference to FIGS. 1-20, wherein like structures and materials are designated by like reference numerals throughout the various figures. The inventors of the present invention disclose herein a structure and method for designing a structure that allows lower actuation voltage. Further, specific processing parameters provided herein are intended to be explanatory rather than limiting.

The process used for fabricating the structures with the recessed electrodes can be both surface-bulk-micromachining processes. In the case of surface micromachining, the process can be performed by fabricating multiple separately patterned sacrificial layers and forming a surface topology of the underside of the mechanical structure so that it is optimal from the performance standpoint. One such possible fabrication process is illustrated below.

FIGS. 1-19 illustrate one method for fabricating the structure of the present invention. FIG. 1 illustrates a cross sectional view of a substrate 2 having a silicon (Si) layer. The substrate 2 can have a diameter of 150 mm, but can also can formed in any diameter, including but not limited to 200 mm and 300 mm.

Figure 2:
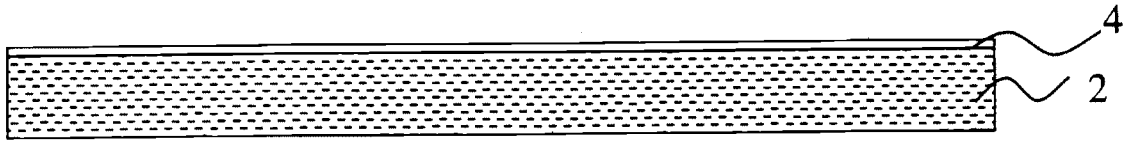
Figure 3:
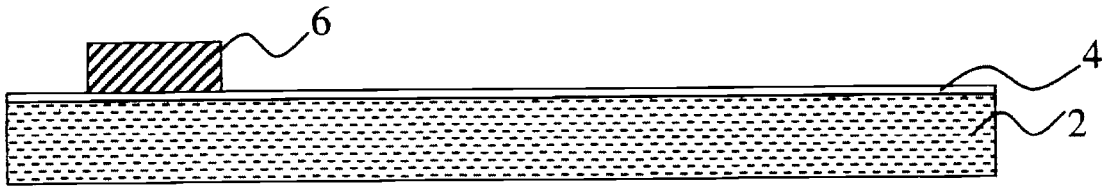

After the substrate 2 is formed, in FIG. 2, a thermal oxide layer 4 of about 0.5 to 1 um is deposited/formed on the substrate 2. Thereafter, in FIG. 3, a conductive layer 6 such as a metal is patterned and grown on the oxide layer 4. The conductive layer 6 may be grown/formed by CVD, sputtering, electroless plating, electro-deposition, electrochemical deposition, etc, or combinations thereof, and then etched. The conductive layer may be a copper layer.

Figure 4:
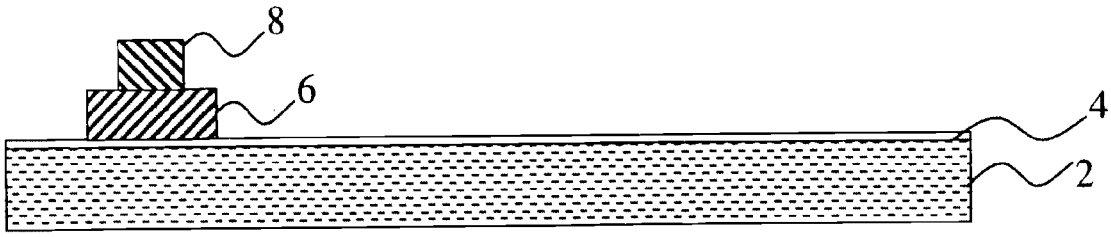
Figure 7:
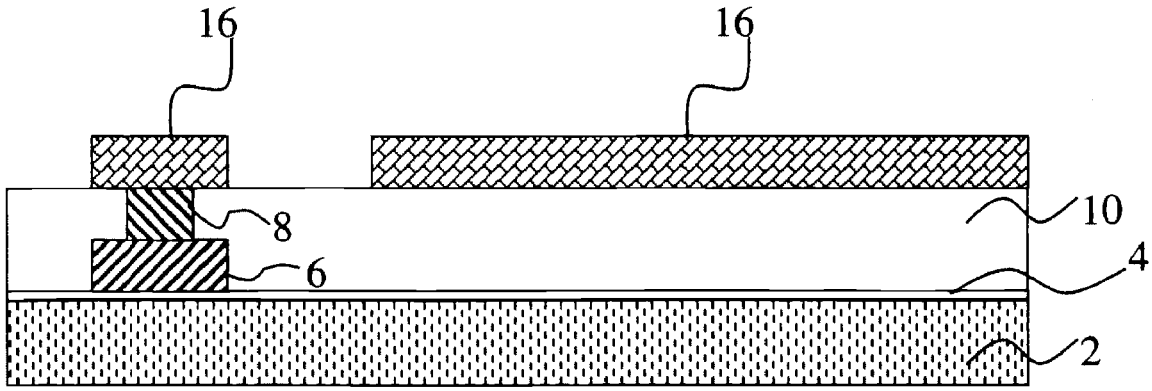

Next, in FIG. 4, a stud 8 is patterned and grown to form the electrical interconnection between the conductive layer 6 and a subsequent second conductive layer 16 layer (see FIG. 7). During this process, the conductive material (e.g., copper) can be electrochemically deposited.

Figure 5:
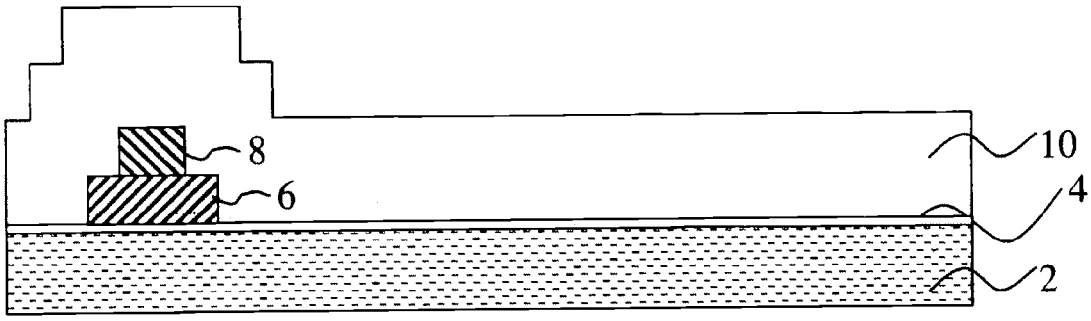
Figure 6:
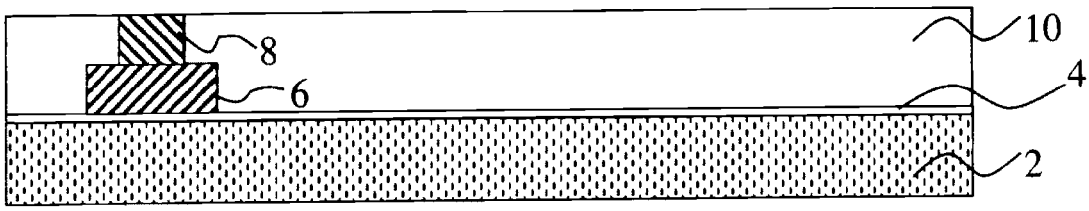

In FIG. 5, a dielectric layer 10 is deposited over the conductive layer 6 and stud 8. The dielectric layer 10 can be formed using PECVD silicon dioxide, or some other sputtered, evaporated or CVD deposited dielectric with suitable electrical and thermal properties. Thereafter, in FIG. 6, a chemical-mechanical planarization (CMP) or other planarization method is performed to planarize the dielectric layer 10 and stud 8 to a desired thickness. This step produces a planar surface, and allows electrical continuity between stud 8 and the second conductive layer 16.

FIG. 7 illustrates the second conductive layer 16 patterned and grown on the dielectric layer 10 and stud 8 to form an electrical bridge from stud 8 towards the upper surface. Again, in this process, metal (i.e., copper) can be deposited using an electrochemical deposition or other conventional method, as known in the art.

Figure 8:
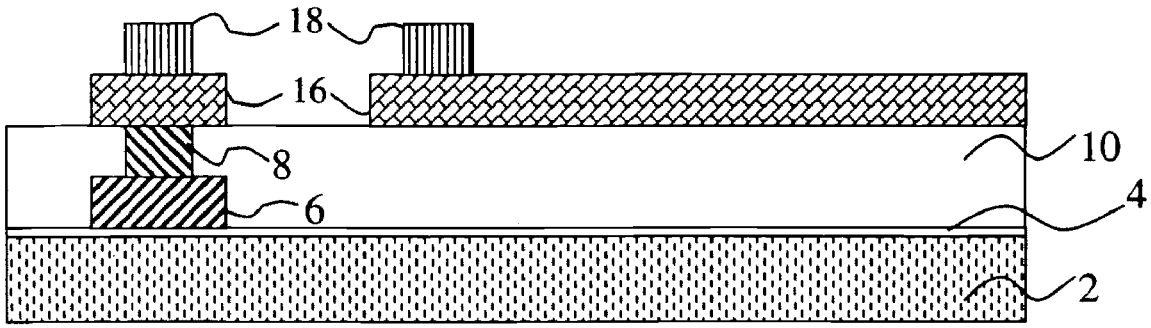
Figure 11:
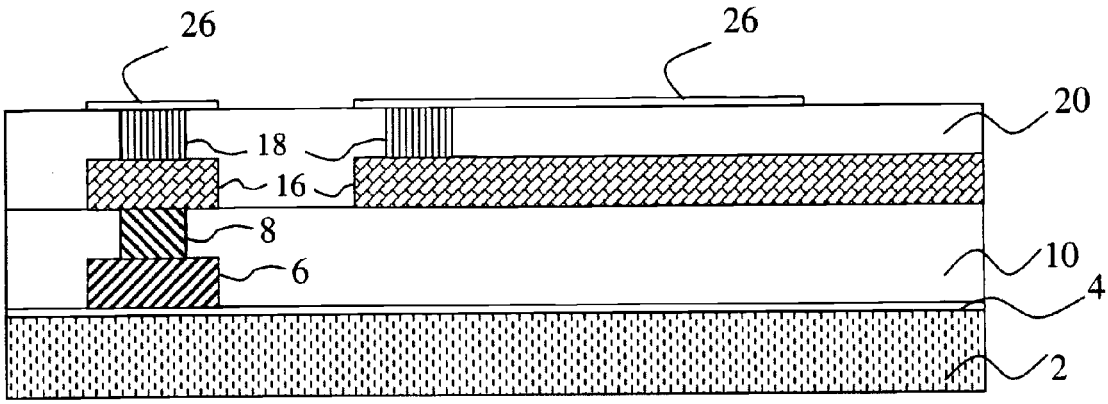
Figure 12:
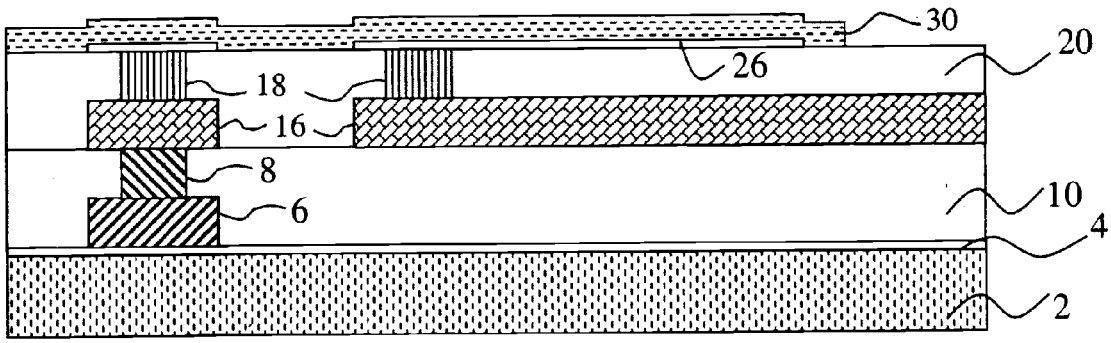

Next, in FIG. 8, a second stud 18 is patterned and grown to form the electrical interconnection between the second conductive layer 16 and a subsequent third conductive layer 26 layer (see FIG. 11). During this process, the conductive material (e.g., copper) can be electrochemically deposited.

Figure 9:
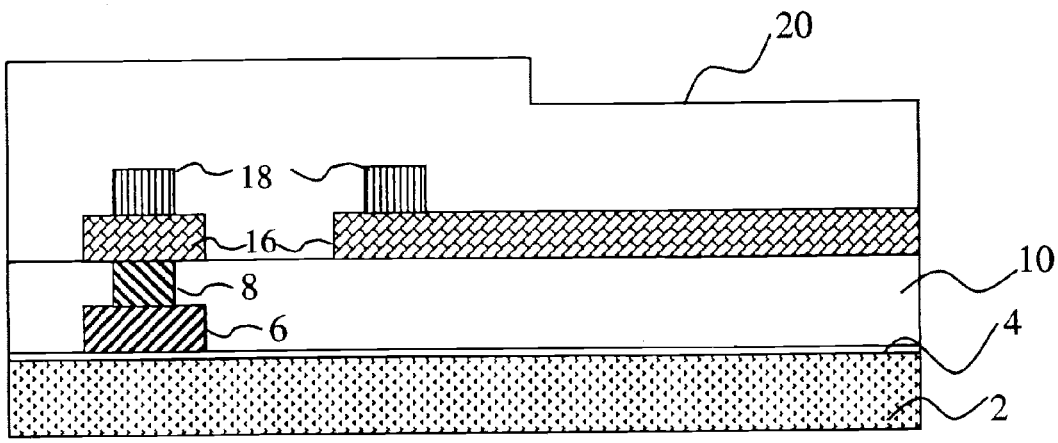
Figure 10:
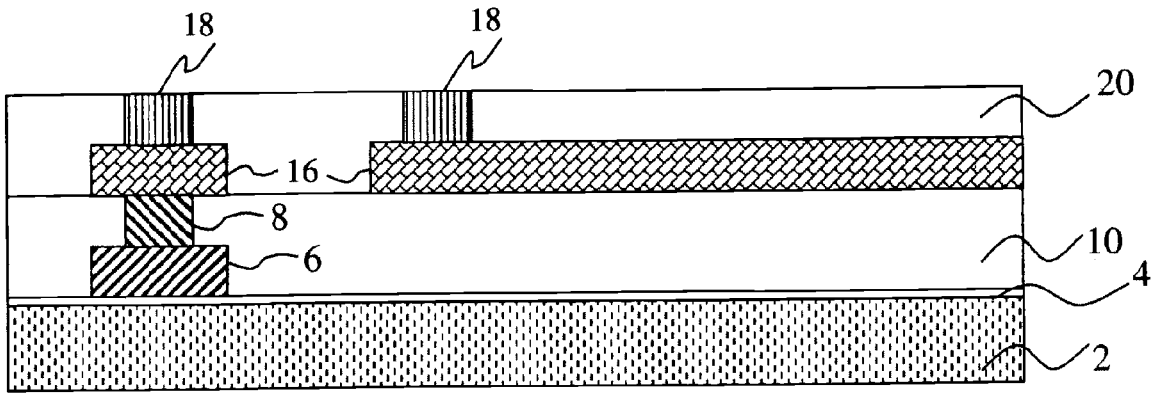

FIG. 9 illustrates a yet another dielectric layer 20 being deposited over the second conductive layer 16 and second stud 18. Again, the dielectric layer 20 can be formed using PECVD silicon dioxide, or some other sputtered, evaporated or CVD deposited dielectric with suitable properties. Thereafter, in FIG. 10, a chemical-mechanical planarization (CMP) or other planarization method is performed to planarize the dielectric layer 20 and second stud 18 to a desired thickness. This step produces a planar surface, and allows electrical continuity between second stud 18 and the third conductive layer 26.

FIG. 11 illustrates a third conducive layer 26 such as gold with an adhesion layer is sputter deposited and patterned by a dry etch process. The metalization is used for the stationary actuation electrode, the stationary contact, and electrical interconnection to the bond pads. Thereafter, in FIG. 12, a first sacrificial layer 30 is patterned and deposited by for example, electrochemical deposition, sputtering, or evaporation over the stationary electrode and the stationary contact. One possible material that can be used for the sacrificial layer 30 can be electroplated copper. The first sacrificial layer is conformal to the surface.

Figure 13:
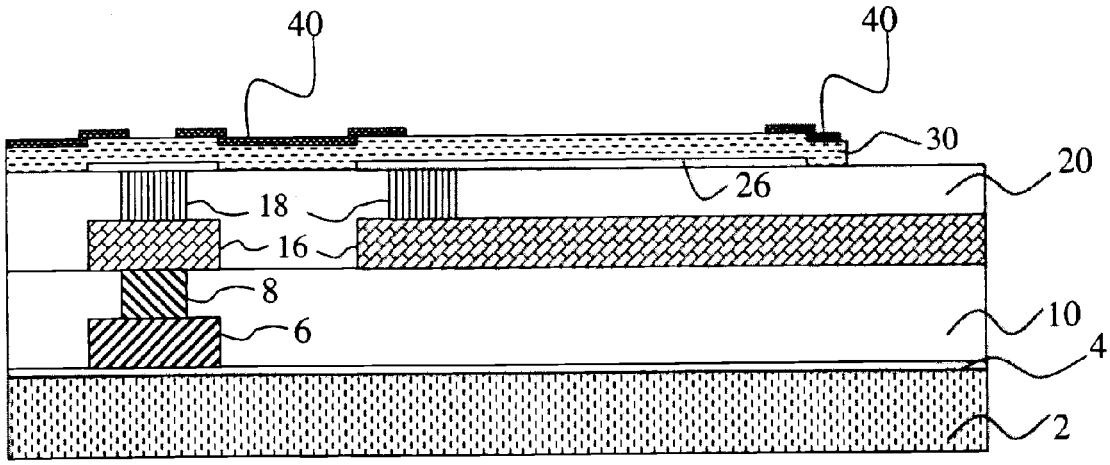

In FIG. 13, a second sacrificial layer 40 is patterned and can be deposited by an electrochemical deposition, sputtering, or evaporation on the first sacrificial layer 30. This step permits the subsequent formation of the contact bump at a lower level than the actuation electrode. As shown, the second sacrificial layer 40 is patterned for shaping the subsequently formed movable electrode and movable contact, shown in FIG. 14. Thus, the movable electrode and the movable contact can have portions that have different gap distances from the stationary electrode and the movable contact area, respectively.

Figure 14:
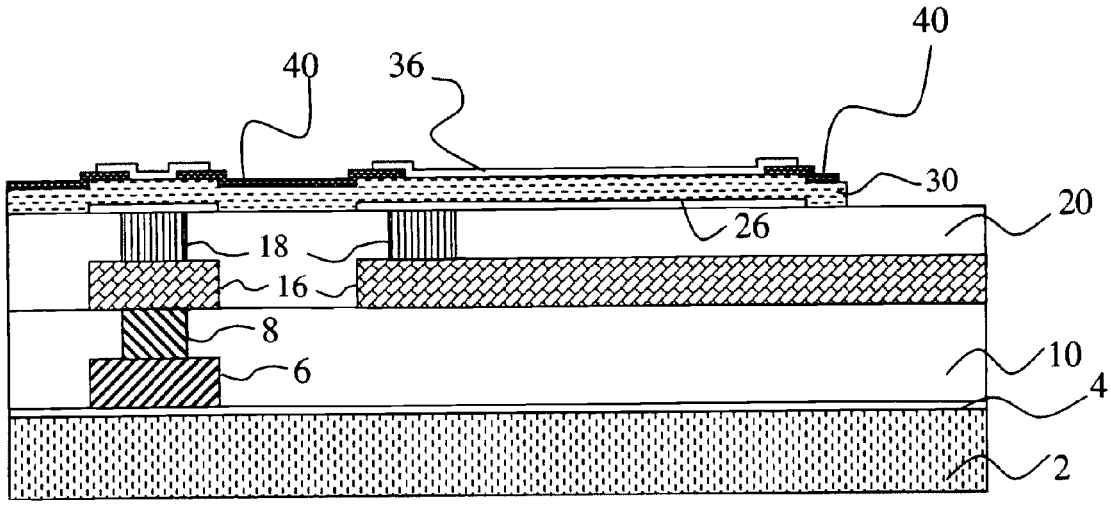

Next, after forming the second sacrificial layer 40, in FIG. 14, a fourth conducive layer 36 (such as gold with an adhesion layer) is deposited and patterned by a dry etch process. The metalization defines the moving actuation electrode and the moving contact pad and is not used for interconnects traversing the sacrificial layer edges.

Figure 15:
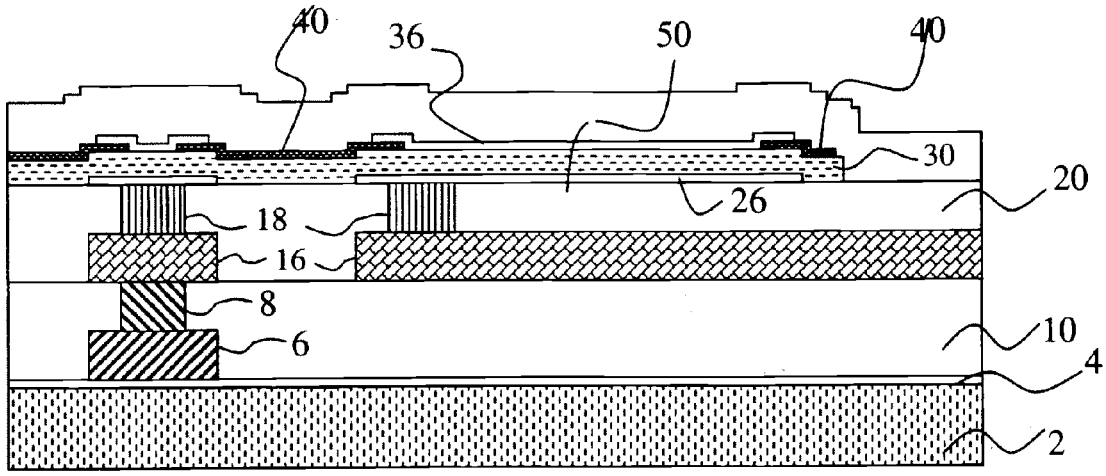

Next, in FIG. 15, a beam oxide layer 50 (PECVD silicon dioxide, or some other dielectric material) is deposited without patterning. When it is subsequently patterned, it will describe the primary structural layer for the switch and the anchor. There is an added benefit of the passivation of the interconnect lines. Furthermore, the second sacrificial layer 40 and first sacrificial layer 30 can be shaped, as shown, for shaping the subsequently formed resilient beam, shown in FIG. 15. Thus, the resilient beam can have portions closer to the base substrate than the movable electrode and the movable contact. Therefore, the patterning and deposition of the first and second sacrificial layers results in a recessed, movable electrode as described above.

Figure 16:
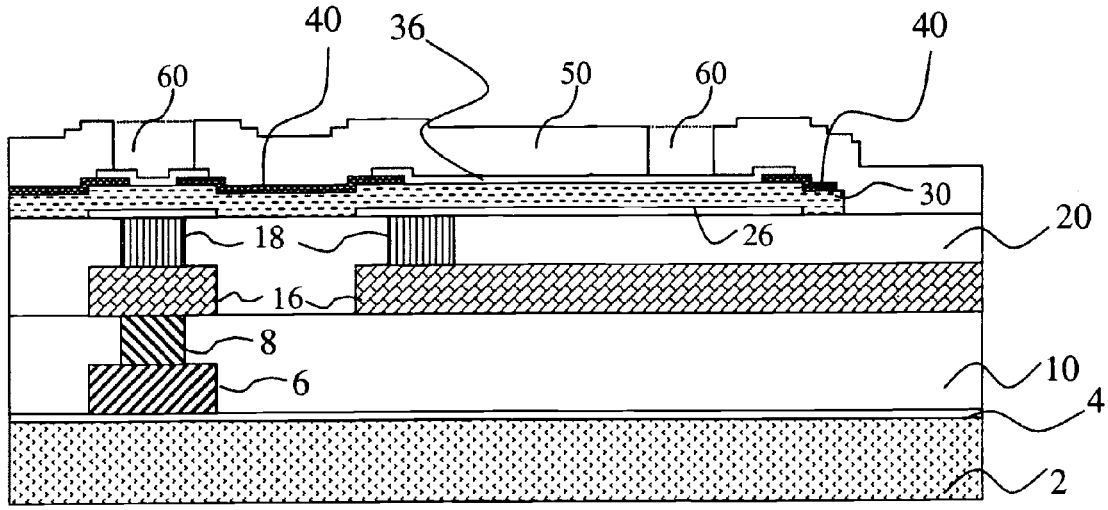

In FIG. 16, vias 60 are etched through the beam oxide layer 50. The vias 60 will provide a path for electrical connection between the fourth conductive layer 36 and the fifth conductive layer 46 (see FIG. 17). Specifically, the vias 60 provide a connection path at the contact, at the actuation electrode, and at the bond pads (not shown in this view). Via 60 sidewalls are sloped from wet etch process and almost vertiical for the dry etching process (which is presented on this figure).

Figure 17:
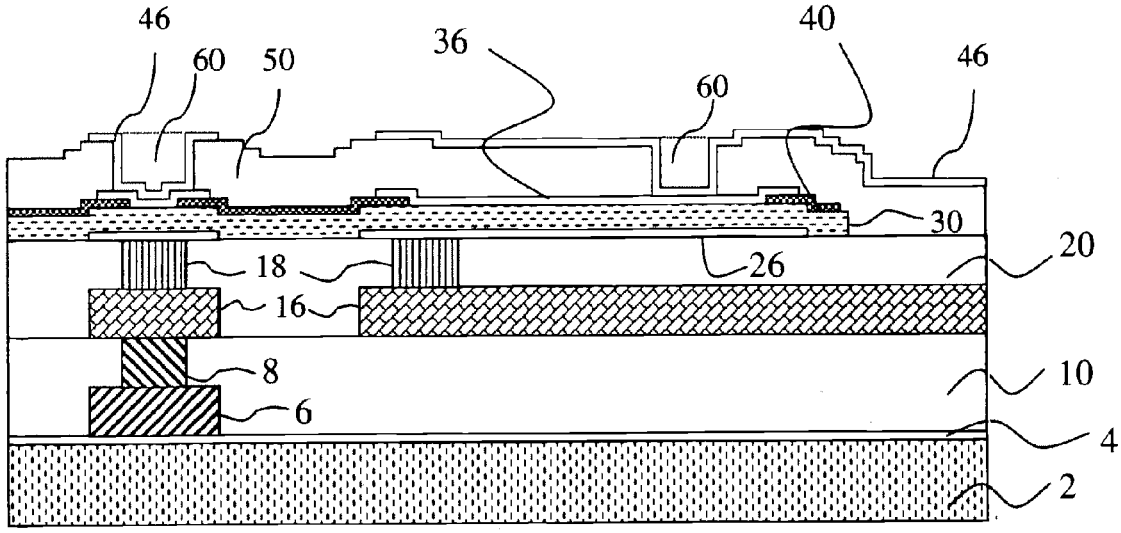
Figure 18:
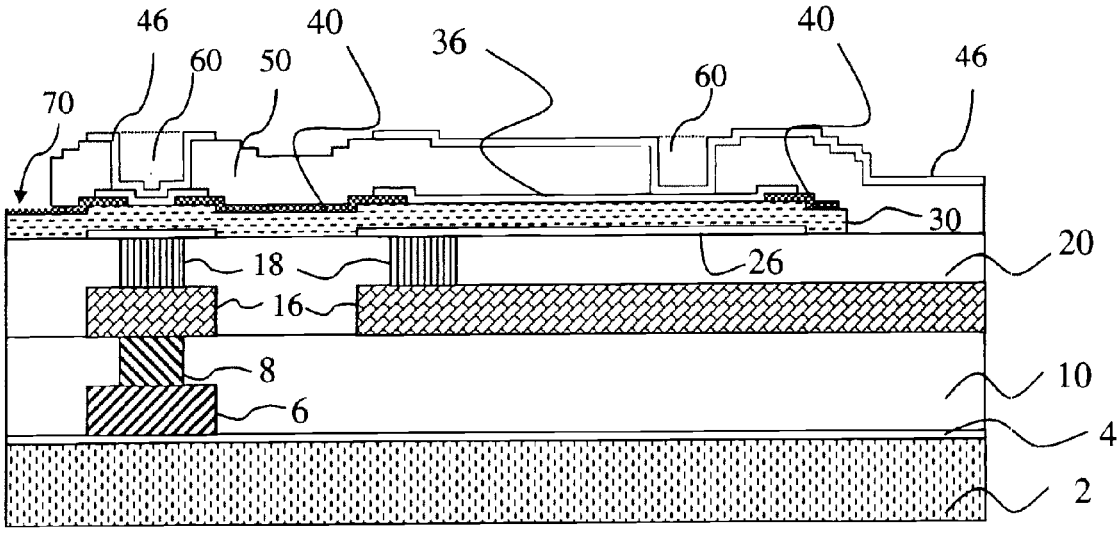

As described above, a fifth conductive layer 46 (for example, gold with an adhesion layer) in FIG. 17 is deposited and patterned with a dry etch process. The metalization is used for electrical connection of the contacts, electrical connection to the actuation electrode, and the top surface of the bond pads. Next, in FIG. 18, the beam oxide layer 50 is patterned and etched during this step. A cut-out 70 is made that defines the free perimeter of the beam oxide layer 50 and is of dimension to permit the efficient removal of the sacrificial layer. A wet etch process will produce beam edges with sloped sidewalls, whereas dry etching will create vertical walls, as shown in this figure.

Figure 19:
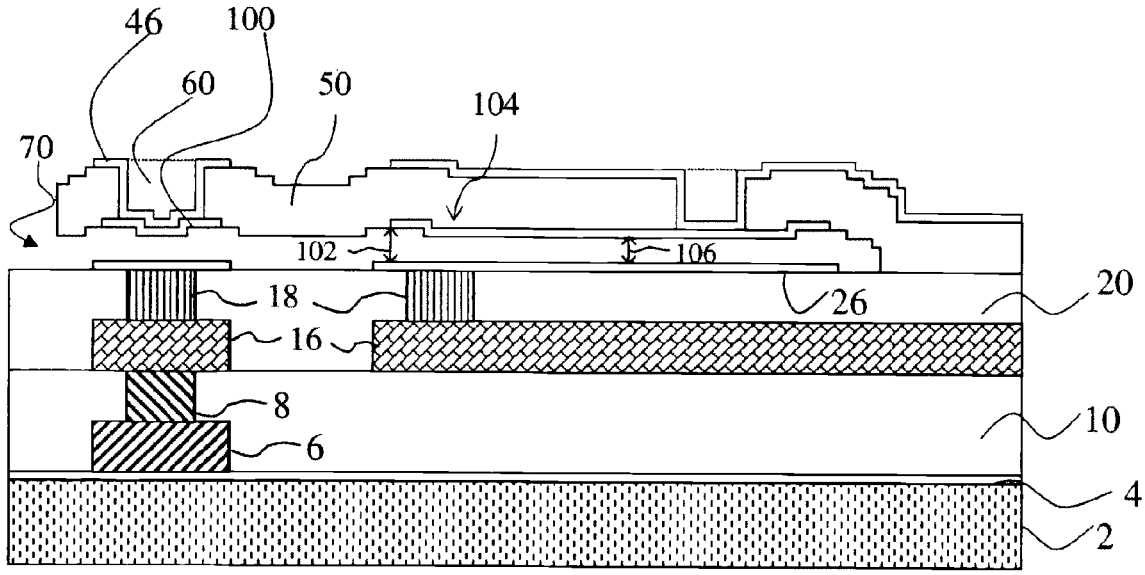

Finally, in FIG. 19, the sacrificial release step is performed to remove the sacrificial material layers 30, 40. Both sacrificial layers 30, 40 are removed during this step to result in the freely suspended structure as shown. Referring to FIGS. 16-19, these steps include etching vias for providing electrical connection between the movable contact and the movable electrode and bond pads on the top side surface of the resilient beam.

The cross section of the structure fabricated with the recessed electrode in accordance with the present invention is shown on FIG. 19. The structure shown in this figure is a switch structure, where the contact region at the bottom of the beam is lower than the cantilever beam supporting it, so that the contact is safely established before the shorting of the actuation electrodes occurs. However, this invention deals with the fact that simultaneously with the patterning of the layers for the definition of the contact region (i.e., the second sacrificial layer and the lower electrode metal layer) the recessed electrode can be formed near the root of the beam. Previously, the actuation electrodes were fabricated that were at the same level with the bottom surface of the mechanical structure (cantilever beam or the doubly supported beam).

As shown in FIG. 19, the MEMS switch includes a base substrate having a resilient beam fixed at one end with respect to the base substrate and including another end suspended over the base substrate. The MEMS switch further includes a stationary contact and a stationary electrode attached to the base substrate. The stationary contact is positioned below a movable contact, generally designated contact area 100, attached to the underside of the resilient beam. The movable and stationary contacts are separated by an air gap. The stationary electrode is positioned below a partially or completely recessed, movable electrode, generally designated recessed electrode 104, attached to the underside of the resilient beam. The movable and stationary electrodes are separated by an air gap.

The movable electrode is recessed within the resilient beam. As shown, a portion of the underside of the resilient beam is positioned lower than the proximate portion of the movable electrode. Furthermore, the movable contact can be positioned lower than the proximate portion of the movable electrode so that contact is made with the stationary contact prior to contact of the electrodes, thus preventing an undesirable electrical short of the electrodes. The movable electrode is formed with portions separated from the stationary electrode by differing gaps. One portion is separated by a first gap, generally designated primary air gap 102. Another portion is separated by a second gap, generally designated secondary air gap 106. The secondary air gap 106 is separated from stationary electrode by a smaller distance than that of the primary air gap 102. The sizes of these portions can be changed in order to vary the actuation, sensing, damping, and other properties of the switch.

RF and DC switches with the low actuation voltages are a very desirable and marketable product. The RF switches with the low actuation voltages have an application in the wireless communications among other applications. When electrostatic actuation is applied, the air gap between the actuation electrode laying on the top of the substrate and the electrode at the bottom of the beam is typically very small, like 2-3 microns. This results in the actuation voltage being low. The other way to increase the electrostatic force would be to increase the surface of the electrodes, but at one point it becomes impractical, because the beam is too compliant and more likely to stick during the release process. Further decreasing of the gap size would also result in stiction problems, and it would make it difficult for the formation of the reliable contact region that is lower than the supporting mechanical structure, because the space would be very limited. Another drawback of such a scenario would be that any stress and curvature of the beam could lead to shorting of the actuation electrodes before the switching occurs.

The present concept of the recessed electrode solves these problems and enables the decreasing of the gap size only at the region close to the root of the beam, so the actuation voltage can be lowered while keeping the same size of the actuation electrodes. Since only the gap at the fixed side of the beam is decreased, the stiction problem and the shorting problem are not significantly aggravated, while the performance of the device is improved.

This concept allows the designer to locally customize/vary the air gap of a device to affect not only the actuation, but sensing, damping, and other properties.

Figure 20:
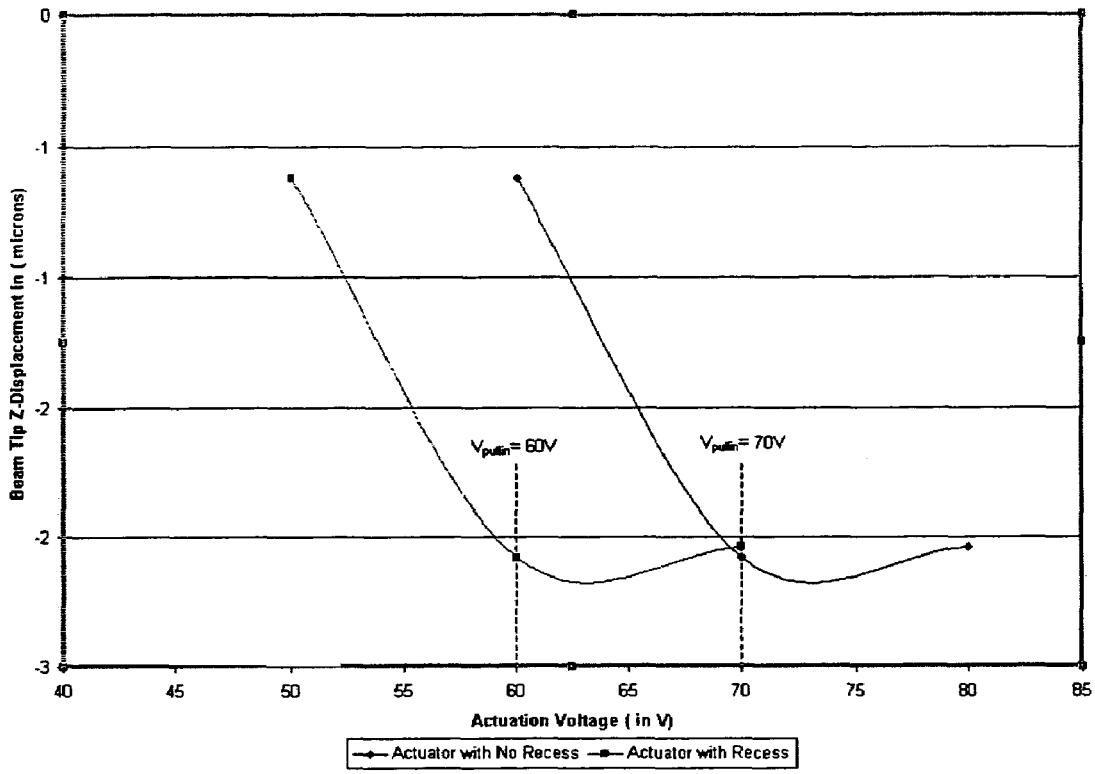
FIG. 20 illustrates a graph showing the difference in the deflection of the tip of the cantilever beam switch as a function of the actuation voltage with and without the recessed electrode.

FIG. 20 illustrates a graph showing the difference in the deflection of the tip of the cantilever beam switch as a function of the actuation voltage with and without the recessed electrode. Some simulations and modeling of such a switch with the recessed electrode have been performed. The simulations are illustrating the improved performance of the device in terms of the desirable low actuation voltage.

A MEMS switch having recessed, movable electrodes according to the present invention can be fabricated using either surface- or bulk-micromachining processes. Referring to FIGS. 1-19 provided after FIG. 1 above, a surface-micromachining process for fabricating a MEMS switch having recessed, movable electrodes according to an embodiment of the present invention is illustrated. Referring to FIG. 1, a starting wafer is provided. Referring to FIGS. 2-10, various interconnects are provided for electrically connecting the stationary electrode and the stationary contact to other suitable devices for interacting with the MEMS switch. Referring to FIG. 11, the stationary electrode and the stationary contact are formed.

Along with using copper and its alloys as the conductive material, other conductive materials such as aluminum, iron, nickel, chromium, indium, lead, tin, lead-tin alloys, non-leaded solderable alloys, silver, zinc, cadmium, titanium, tungsten molybdenum, ruthenium, gold, paladium, cobalt, rhondium, platinum, their respective alloys and various combinations of above material with oxygen, nitrogen, hydrogen and phosphorous may be used in the present invention.

In the previous descriptions, numerous specific details are set forth, such as specific materials, structures, processes, etc., to provide a thorough understanding of the present invention. However, as one having ordinary skill in the art would recognize, the present invention can be practiced without resorting to the details specifically set forth.

Although various preferred embodiments have been described in detail above, those skilled in the art will readily appreciate that many modifications of the exemplary embodiment are possible without materially departing from the novel teachings and advantages of this invention.

What is claimed is:

1. A method for fabricating an actuator having a recessed, movable electrode, comprising the steps of:

(a) forming a stationary electrode having first and second ends on a substrate;

(b) depositing a first sacrificial layer on the stationary electrode and the substrate;

(c) depositing a second sacrificial layer on the first sacrificial layer;

(d) patterning the second sacrificial layer in such a manner that the patterned second sacrificial layer includes a recessed portion on the first sacrificial layer located over the second end of the stationary electrode, and the second sacrificial layer is completely removed from a proximal portion of the first sacrificial layer located over a central portion of the stationary electrode between the first and second ends;

(e) forming a movable electrode having a first portion over the patterned recessed portion of the second sacrificial layer and a second portion over the proximal portion of the first sacrificial layer;

(f) depositing a structural layer on the first sacrificial layer, the second sacrificial layer, and the movable electrode; and (g) removing a sufficient amount of the first and second sacrificial layers so as to separate the movable electrode from the substrate, wherein the structural layer is supported by the substrate at a fixed end and is freely suspended above the substrate at an opposing suspended end, and wherein the second portion of the movable electrode is separated from the substrate by a distance less than the distance separating the first portion from the substrate.

2. The method according to claim 1 wherein the second portion of the movable electrode is closer to the suspended end of the structural layer than the first portion of the movable electrode and the first portion of the movable electrode is closer to the fixed end of the structural layer than the second portion of the movable electrode.

* * * * *